US007163313B2

(12) United States Patent
Rosenberg

(10) Patent No.: US 7,163,313 B2
(45) Date of Patent: Jan. 16, 2007

(54) ILLUMINATION DEVICE

(76) Inventor: Maury Rosenberg, 1525 E. Putman Ave., Apt. 301, Old Greenwich, CT (US) 06870

( * ) Notice: Subject to any disclaimer, the term of this patent is extended or adjusted under 35 U.S.C. 154(b) by 149 days.

(21) Appl. No.: 10/968,635

(22) Filed: Oct. 19, 2004

(65) Prior Publication Data

US 2005/0094395 A1 May 5, 2005

Related U.S. Application Data

(60) Provisional application No. 60/517,304, filed on Nov. 4, 2003.

(51) Int. Cl.
*F21L 4/02* (2006.01)

(52) U.S. Cl. ..... 362/184; 362/154; 362/186; 362/190

(58) Field of Classification Search ..... 362/184, 362/154, 155, 186, 190, 191, 208, 249, 252
See application file for complete search history.

(56) References Cited

U.S. PATENT DOCUMENTS

| | | | | |
|---|---|---|---|---|
| 2,849,819 | A * | 9/1958 | Murphy et al. | 446/153 |
| 3,610,916 | A * | 10/1971 | Meehan | 362/363 |
| 3,804,411 | A * | 4/1974 | Hendry | 473/570 |
| 4,835,665 | A | 5/1989 | Kao | 362/184 |
| 5,865,529 | A | 2/1999 | Yan | 362/327 |
| 6,042,487 | A * | 3/2000 | Schrimmer et al. | 473/353 |
| 6,305,821 | B1 | 10/2001 | Hsieh et al. | 362/246 |
| 6,428,432 | B1 | 8/2002 | Kachel | 473/570 |
| 6,450,661 | B1 | 9/2002 | Okumura | 362/240 |
| 6,511,214 | B1 | 1/2003 | Parsons et al. | 362/398 |
| 6,773,139 | B1 * | 8/2004 | Sommers | 362/237 |
| 6,783,258 | B1 | 8/2004 | Ryan, Jr. | 362/249 |
| 6,860,628 | B1 * | 3/2005 | Robertson et al. | 362/555 |
| 2001/0049311 | A1 * | 12/2001 | Lewis et al. | 473/570 |

* cited by examiner

*Primary Examiner*—Thomas M. Sember
(74) *Attorney, Agent, or Firm*—St. Onge Steward Johnston & Reens LLC

(57) ABSTRACT

An illumination device is disclosed generally comprising a translucent housing with a plurality of light sources and a power source disposed therein. The light sources emit very high intensity light and are arranged such that light emanates from the housing omnidirectionally in order illuminate the entire surrounding area. In some embodiments, light emitting diodes of at least 3000 MCD and wide viewing angles are employed. In certain embodiments, a housing specifically adapted for easy power source replacement and disconnection of the power source is utilized.

38 Claims, 4 Drawing Sheets

ILLUMINATION DEVICE

RELATED APPLICATIONS

This patent application claims the benefit of, under Title 35, United States Code, Section 119(e), U.S. Provisional Patent Application No. 60/517,304, filed Nov. 4, 2003.

FIELD OF THE INVENTION

The present invention relates to an apparatus for illuminating a darkened environment. More specifically, the invention relates to an self-contained device for providing a very bright light to the entire area surrounding the device.

BACKGROUND OF THE INVENTION

Various types of illumination devices are generally well known in the art. Self-contained illumination devices, such as flashlights, portable lamps, decorative lights, and the like employ the use of a light source powered by a replaceable power source, such as disposable or rechargeable batteries. For example, U.S. Pat. No. 4,835,665 to Kao discloses an emergency flashlight that has a traditional flashlight housing containing a continuously burning bulb and a battery power source for providing continuous, directed light, as well as a separate housing (detection box) containing a flashing user lamp and a battery power source for producing intermittent bursts of light. Often, such devices employ incandescent bulbs, which typically include a coiled tungsten wire filament disposed in a glass casing, which is usually filled with an inert gas such as krypton, halogen, or xenon. The ends of the wire filament are connected to the ends of corresponding wires that supply electrical current, which, in turn, are usually connected to terminals in the base of the bulb that facilitate connection to a source of electrical power, such as a battery. As current flows through the wire filament, it heats to a very high temperature and gives off visible light. There are, however numerous disadvantages to such devices, including, among other things, that the intensity of the light is limited and the radiation of the light is directional, resulting in a limited degree of illumination, for a limited spatial area, at any particular point in time. Additionally, the device, as well as the power sources required to power the device, are usually cumbersome, easily broken, and somewhat expensive to manufacture.

It has been suggested to use light emitting diodes in portable illumination devices, such as in the device disclosed in U.S. Pat. No. 6,511,214 to Parsons et al. However, similar problems still result, as these diodes emit light in a relatively directional manner, thereby limiting the amount of area that can be illuminated at any one time. Similarly, because any attempts to maximize the intensity of the light emitted by the diodes will result in excessive consumption of power, weak diodes must be used, or the current supplied to the diodes must be substantially restricted, whenever a self-contained illumination device is involved, as the portable power source will quickly be expended.

What is desired, therefore, is a device that can illuminate a very large area at once. What is further desired is a device that can produce very high intensity light for extended periods of time. What is also desired is a device that is not cumbersome, easily broken, or expensive to manufacture.

SUMMARY OF THE INVENTION

Accordingly, it is an object of the present invention to provide an illumination device that radiates light in all directions.

It is a further object of the present invention to provide an illumination device that produces light with a very high intensity.

It is yet another object of the present invention to provide an illumination device that is compact.

It is still another object of the present invention to provide an illumination device in which the power source is very easily disconnected from the light sources.

It is yet another object of the present invention to provide an illumination device in which the power source is easily replaced.

In order to overcome the deficiencies of the prior art and to achieve at least some of the objects and advantages listed, the invention comprises an illumination device, including a translucent housing, a plurality of light sources disposed in the housing for radiating light, and at least one replaceable power source disposed in the housing for powering the light sources, wherein the light sources are arranged in the housing such that light radiates from the housing omnidirectionally.

In another embodiment, the invention comprises an illumination device, including a housing having an outer surface, the housing comprising a first housing portion having a first translucent surface comprising part of the outer surface of the housing, and a second housing portion coupled to the first housing portion along a plane having an x-axis and a y-axis, the second housing portion having a second translucent surface comprising part of the outer surface of the housing, at least one light source disposed in the first housing portion for radiating light through the first translucent surface, wherein the at least one light source is positioned such that light radiates away from the plane in approximately one hundred and eighty degrees along both the x-axis and the y-axis of the plane, at least one additional light source disposed in the second housing portion for radiating light through the second translucent surface, wherein the at least one additional light source is positioned such that light radiates away from the plane in approximately one hundred and eighty degrees along both the x-axis and the y-axis of the plane, and at least one replaceable power source disposed in the housing for powering the light sources.

In yet another embodiment, the invention comprises an illumination device, including a housing having a translucent surface, at least one light emitting diode disposed in the housing for radiating light through the translucent surface, wherein the at least one diode is at least about 3000 MCD, and at least one replaceable battery disposed in the housing for powering the at least one diode, wherein the housing comprises first and second housing portions, wherein the first portion is removably coupled to the second portion for allowing replacement of the at least one battery.

DETAILED DESCRIPTION OF THE DRAWINGS

Figure 1A:
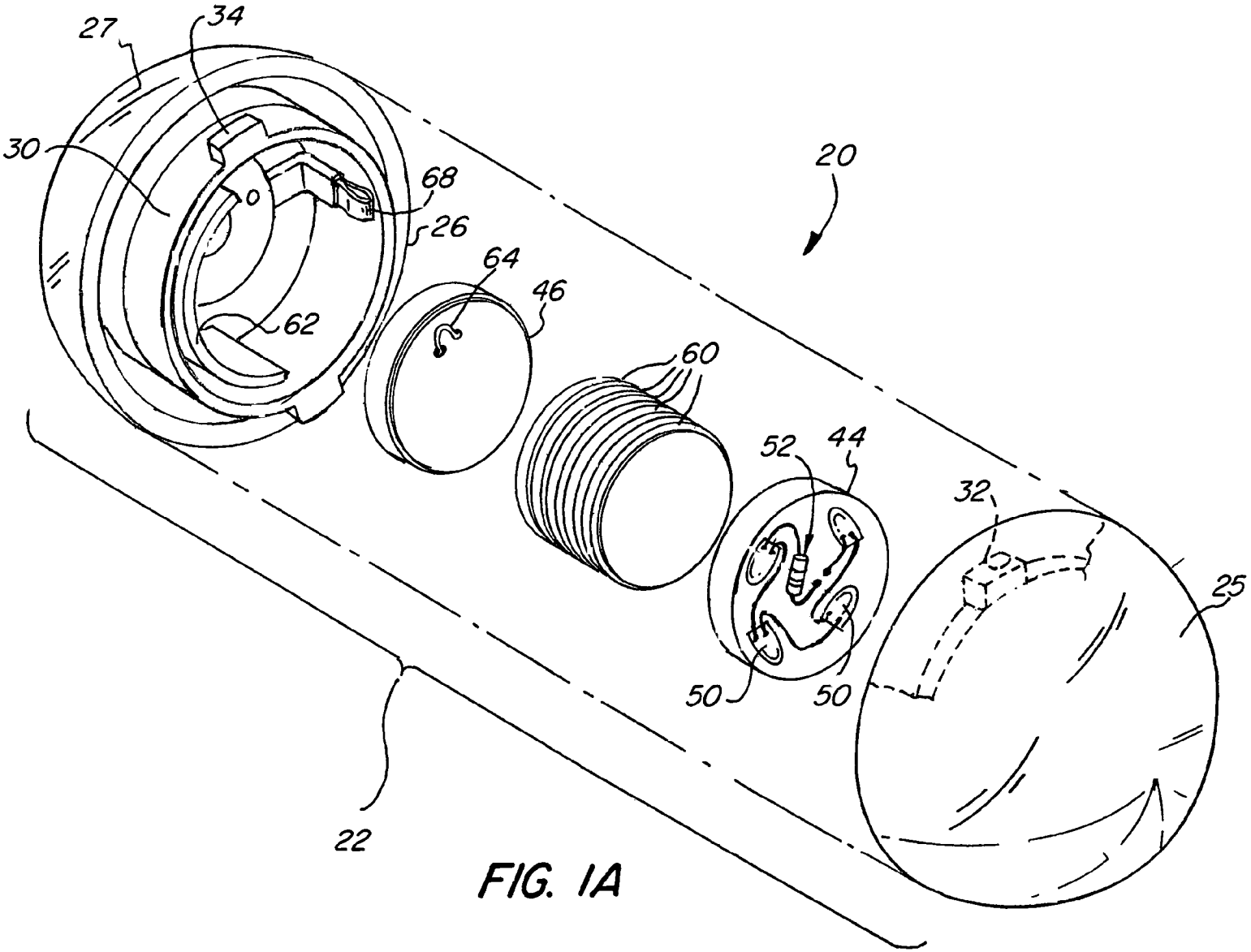
FIG. 1A is an exploded isometric view of an illumination device in accordance with the invention.
Figure 1B:
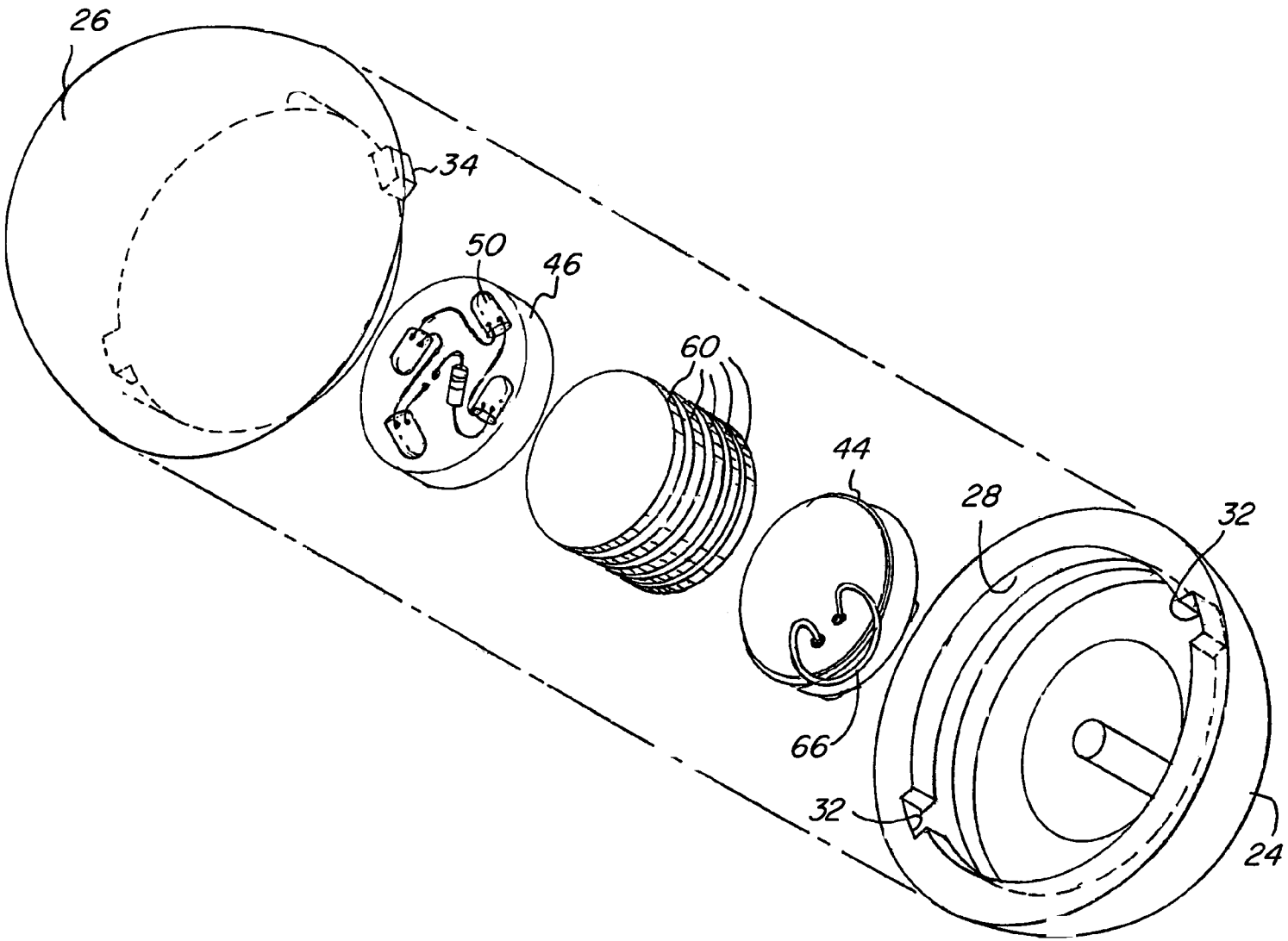
FIG. 1B is another exploded isometric view of the illumination device of FIG. 1B.

The basic components of one embodiment of an illumination device in accordance with the invention are illustrated in FIGS. 1A–B. As used in the description, the terms "top," "bottom," "above," "below," "over," "under," "above," "beneath," "on top," "underneath," "up," "down," "upper," "lower," "front," "rear," "back," "forward" and "backward" refer to the objects referenced when in the orientation illustrated in the drawings, which orientation is not necessary for achieving the objects of the invention.

The illumination device 20 includes a translucent housing 22 having a first portion 24 and a second portion 26. The first housing portion 24 has a first coupling surface 28, and the second housing portion 26 has a second coupling surface 30 for engaging the first coupling surface 28. In order to couple the second portion 26 to the first portion 24, the second surface 30 is inserted into the first surface 28 and is rotatable therein. The first portion 24 is coupled to the second portion 26 along a plane 23, and the first portion 24 is rotatable with respect to the second portion 26 along the plane 23.

Figure 2A:
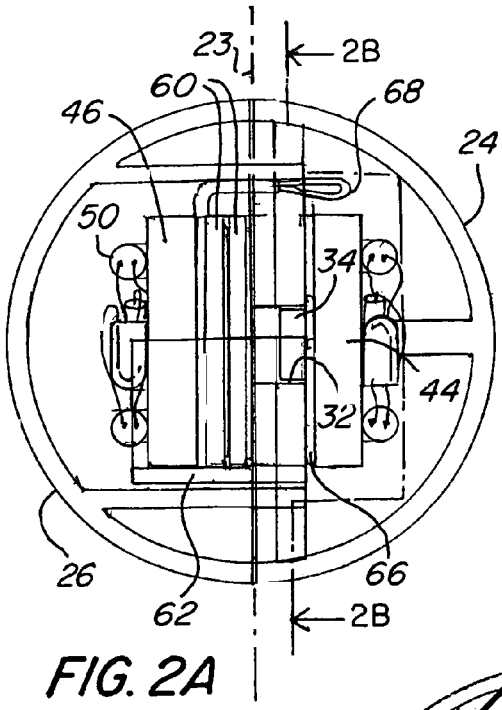
FIG. 2A is a side elevational view of the illumination device of FIGS. 1A–B in a locked, disengaged position.
Figure 2B:
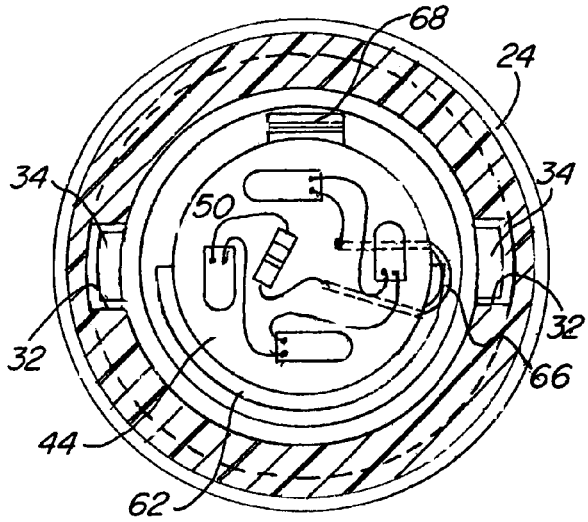
FIG. 2B is a side elevational view of the illumination device of FIG. 2A in an unlocked position.

In certain advantageous embodiments, the housing 22 has a locking mechanism for retaining the first portion 24 adjacent the second portion 26 such that, when the first portion 24 is rotated with respect to the second portion 26 from a locked position to an unlocked position, the first portion 24 can be separated from the second portion 26. In the particular embodiment illustrated in FIGS. 1A–1B, the first surface 28 has at least one gap 32 therein, while the second surface 30 has at least one protuberance 34 corresponding to the shape of the gaps 32. Accordingly, as illustrated in FIGS. 2A and 2B, when the first portion 24 is rotated such that the protuberances 34 are adjacent the gaps 32, the housing 22 is in the unlocked position, and the protuberances 34 can slide through the gaps 32 in order to separate the first portion 24 from the second portion 26. In certain advantageous embodiments, the protuberances 34 are shaped such that the first and second portions 24, 26 must first be pressed together in order to permit the protuberances 34 to slide through the gaps 32, thereby preventing the accidental separation of the first portion 24 from the second portion 26 when the user is rotating the first portion 24 relative to the second portion 26 in order to turn the illumination device 20 on or off, as is further described below.

The first and second portions 24, 26 have first and second translucent surfaces 25, 27, respectively, which together form the outer surface of the housing 22. In some embodiments, the housing 22 is made from a very durable translucent material, such as Plexiglas or PVC. The housing 22 can have various levels of translucency, permitting various levels of intensity and various wavelengths of light to pass through it. For example, in some embodiments, the housing 22 is clear, resulting in complete transparency. In other embodiments, the housing 22 may be fashioned from a material having a certain level of opacity in order to dim the intensity of light radiating from within it. In some embodiments, the inner or outer surface of the housing 22 itself is etched or pocked, while in other embodiments, the inner or outer surface of the housing 22 is covered with a coating that partially inhibits the passage of light, such as a frosted surface. In yet other embodiments, the housing 22 is fashioned from, or is coated with, a material for filtering particular wavelengths of light. In still other embodiments, the housing 22 may have be constructed from an array of prismatic or kaleidoscopic structures for refracting of diffusing the light emanating from within.

In certain advantageous embodiments, the housing 22 is spherical. Accordingly, in some of these embodiments, the first and second portions 24, 26 are first and second hemispheres. However, in other advantageous embodiments, the housing 22 is may be another desirable shape, such as, for example, a spheroid, ellipsoid, ovoid, octahedron, or any other three-dimensional object relatively conducive to radiating light in many directions. Additionally, in certain advantageous embodiments, the first and second portions 24, 26 are coupled together to form a waterproof housing 22.

In the embodiment illustrated in FIGS. 1A–B, the first and second portions 24, 26 have first and second support members 44, 46, respectively. A plurality of light sources 50 are disposed on each of the support members 44, 46, between the respective support member and the wall of the housing 22. Accordingly, when power is supplied to the light sources 50, they radiate light through the translucent housing 22.

In certain advantageous embodiments, the light sources 50 emit white light in order to maximize brightness and provide the user of the illumination device 20 with an undistorted perception of the environment in which the device 20 is used. However, it is contemplated that the illumination device 20 may be used in environments where color-specific effects are desired, such as, for example, when used at social functions, when used as a temporary light in a holiday setting, etc. Accordingly, in these embodiments, the light sources 50 emit the particular, desired wavelengths of light, such as, for example, red or green light. Similarly, while in many embodiments, visible light is emitted, it is contemplated that the illumination device 20 may be used in environments requiring forms of light outside the spectrum of visible light, such as, for example, in darkrooms, in military settings utilizing specialized optics, etc. Accordingly, in these embodiments, the light sources 50 emit wavelengths of light outside the visible spectrum, such as, for example, infrared or ultraviolet light.

In certain advantageous embodiments, the light sources 50 are light emitting diodes, such as, for example, water clear diodes. These diodes, which are made from certain semiconductors, can emit significant radiation. However, in certain other embodiments, other light emitting devices are used, including, but not limited to, liquid crystal elements, fluorescent, phosphorescent, incandescent, laser, bioluminescent, chemiluminescent, or combinations thereof.

The diodes 50 are arranged on each of the support members 44, 46. Accordingly, light radiates out away from the plane 23, through the translucent surface of the housing 22, on both sides of the plane 23. The diodes 50 are arranged such that light radiates away from the plane 23 in approximately one hundred and eighty degrees along both the x-axis and the y-axis of the plane 23.

In certain advantageous embodiments, the diodes 50 have viewing angles of at least ninety degrees, though very wide viewing angles are generally most advantageous. In the embodiment illustrated in FIG. 1A, the diodes 50 are arranged on the support member 44 in a substantially a spherical array. This array of diodes 50, which are connected in series, is substantially perpendicular to the plane 23. A similar arrangement exists on the support member 46. In this way, light can radiate from the housing 22 omnidirectionally.

In certain advantageous embodiments, the light emitting diodes 50 are at least about 3000 MCD. Accordingly, a very high level of intensity is achieved, and thus, the device 20 produces a very bright light. In some of these embodiments, a resistor 52 is employed in order to reduce the brightness of the diodes 50 so that the device 20 is not harmful to the eyes and that the diode is not ruined. By reducing the value of the resistor 52, the brightness of the diodes 50 can be increased. Though a single resistor 52 may be used, other combinations of resistors in series or parallel may be used to achieve the desired resistance.

Figure 3:
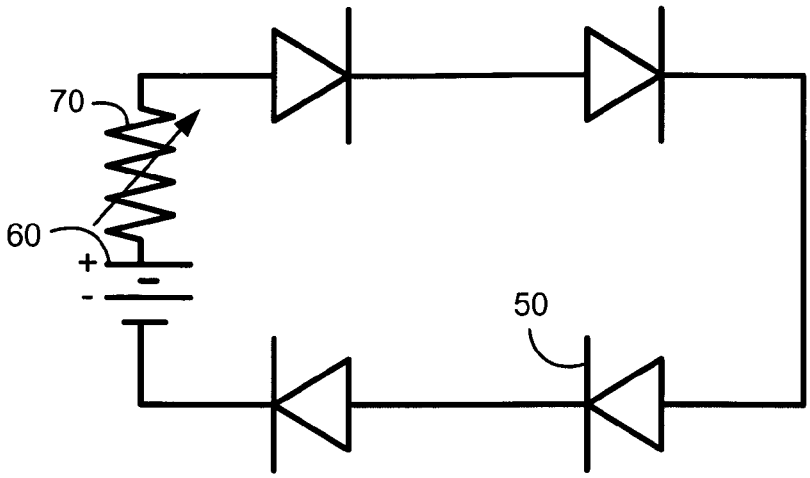
FIG. 3 is schematic view of circuitry of the illumination device of FIGS. 1A–B.
Figure 4:
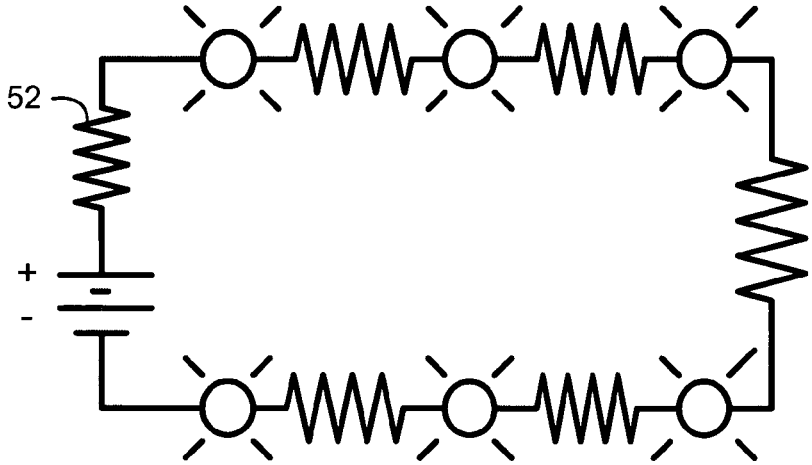
FIG. 4 is schematic view of circuitry of the illumination device of FIGS. 1A–B.
Figure 5:
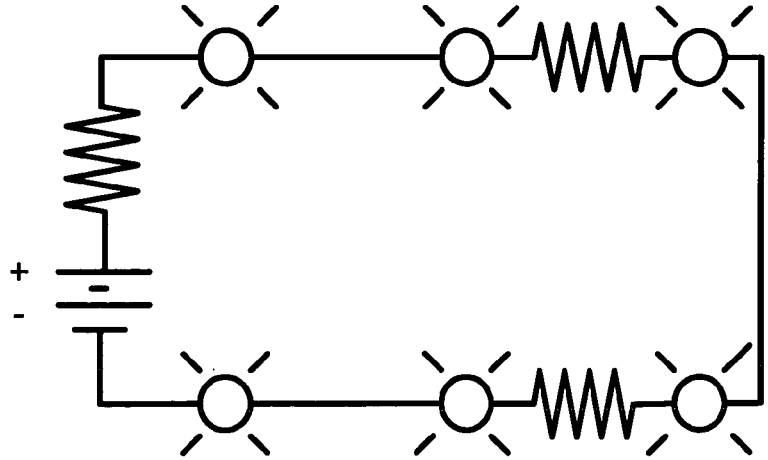
FIG. 5 is schematic view of circuitry of the illumination device of FIGS. 1A–B.

As illustrated in FIGS. 3–5, different circuit configurations may be employed. For example, in embodiments using non-diode light sources, which rely on the rotatable structure of the device 20 explained herein to disconnect and replace the power sources to reduce power consumption, it may be desired to place individual resistors in between certain individual light sources, as shown in FIGS. 4–5.

As shown in FIG. 3, in some embodiments, a rheostat 70 may be employed to complete the circuit, thereby providing variable levels of resistance, and thus, variable levels of brightness from the diodes 50. These various levels of brightness can be achieved by turning the first housing portion 24 to various positions relative to the second housing portion 26. The rheostat 70 can be used in addition to the resistor 52, or alternatively, the rheostat 70 itself can be capable of achieving the maximum resistance desired, and thus, the resistor 52 can simply be eliminated from the circuit.

At least one replaceable power source 60 is disposed in the housing 22 for power the diodes 50. In certain advantageous embodiments, the power source includes a number of small, disposable batteries, such as, for example, three volt lithium button batteries. In the particular embodiment illustrated in FIG. 1A, the housing 22 includes an inner wall 62 sized and shaped to accommodate the batteries 60. Accordingly, the wall 62, along with the support member 46, form a cavity into which the batteries 60 can be disposed. When the first housing portion 24 is coupled to the second housing portion 26, the batteries 60 are sandwiched between the first and second support members 44, 46. The support members 44, 46 may have electric leads 64 located on the underside thereof, which the batteries 60 contact when the housing portions 24, 26 are coupled together, and to which the diodes 50 located on the top side of the respective support member are electrically connected. Because the first and second housing portions 24, 26 are easily separated as described above, the diodes 50 can be pushed to extreme levels of brightness, as the batteries 60 can be easily and quickly replaced when their power is expended.

Figure 2C:
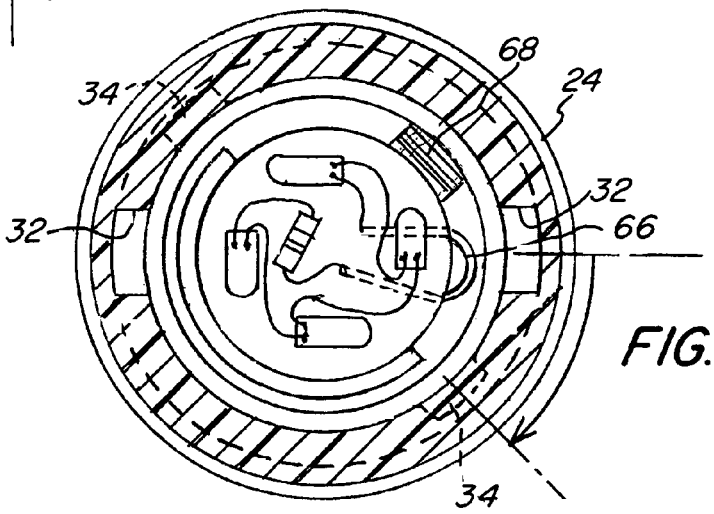
FIG. 2C is a side elevational view of the illumination device of FIG. 2A in an engaged position.
Figure 2D:
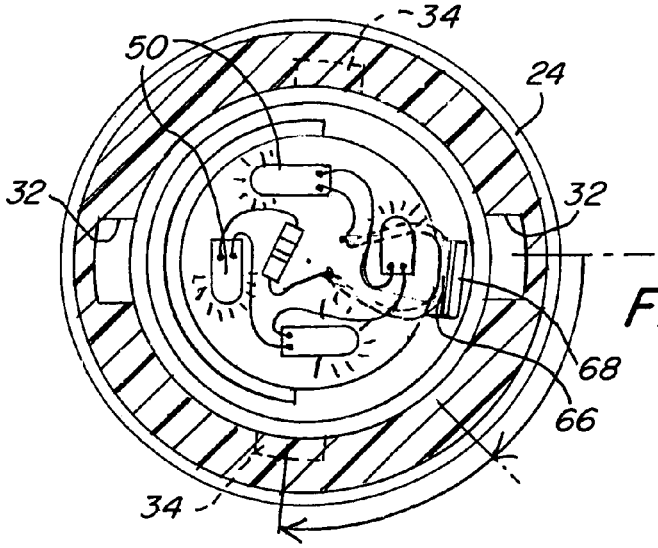

In order ensure that the diodes 50 are activated only when needed by the user in light of the large drain on the batteries 60, a switch is provided within the housing 22 in order to complete and break the circuit. In certain advantageous embodiments, two electrical components are brought into contact with each other as the first housing portion 24 is rotated with respect to the second housing portion 26 from a disengaged position to an engaged position. For example, as shown in FIGS. 1A–B, the second housing portion may include a conductive splint 68, a first end of which is connected to the diode array located on the top side of the support member 46. As shown in FIGS. 2A and 2C, when the first housing portion 24 is rotated with respect to the second housing portion 26, the second end of the splint 68 comes into contact with the lead 66 on the support member 46, thereby completing the circuit and activating the diodes 50. When the first housing portion 24 is rotated back to a disengaged position, this electrical connection is severed, and the circuit is broken, thereby unactivating the diodes 50 and conserving battery power.

Alternatively, the aforementioned electrical connection may be controlled by any other suitable type of switch, such as, for example, a push button switch (not shown). In some embodiments, the push button switch may protrude slightly from, form part of, or be slightly embedded within, the surface of the housing 22, such that an operator can turn the illumination device 20 on and off by manually pushing the button. In other embodiments, the switch may exist within the housing 22 and be activated by an actuator therein. For example, a push button switch may be located within the housing 22, and the actuator may simply be a protuberance protruding from the first portion of the housing 22 such that, when the first housing portion is rotated relative to the second housing portion to an engaged position, the actuator comes into contact with, and exerts a force on, the push button switch.

It should be understood that the foregoing is illustrative and not limiting, and that obvious modifications may be made by those skilled in the art without departing from the spirit of the invention. Accordingly, reference should be made primarily to the accompanying claims, rather than the foregoing specification, to determine the scope of the invention.

What is claimed is:

1. An illumination device, comprising:

a translucent housing;

a plurality of light sources disposed in said housing for radiating light; and at least one replaceable power source disposed in said housing for powering said light sources;

wherein said light sources are arranged in said housing such that light radiates from said housing omnidirectionally;

wherein said housing comprises a first portion coupled to a second portion;

wherein said at least one power source is electrically connected to said plurality of light sources; and wherein said first portion is rotatable with respect to said second portion such that, when said first portion is rotated from an engaged position to a disengaged position, the electrical connection between said at least one power source and said plurality of light sources is severed.

2. The illumination device of claim 1, wherein said housing is spherical.

3. The illumination device of claim 1, wherein said first portion comprises a first hemisphere and said second portion comprises a second hemisphere.

4. The illumination device of claim 1, wherein said plurality of light sources comprises a plurality of light emitting diodes.

5. The illumination device of claim 4, further comprising at least one resistor, wherein said at least one resistor and said plurality of diodes are connected in series.

6. The illumination device of claim 4, further comprising a rheostat, wherein said rheostat and said plurality of diodes are connected in series.

7. The illumination device of claim 4, wherein said diodes comprise water clear diodes.

8. The illumination device of claim 4, wherein said light emitting diodes have a viewing angle of at least about ninety degrees.

9. The illumination device of claim 4, wherein said light emitting diodes are at least about 3000 MCD.

10. The illumination device of claim 1, wherein said power source comprises at least one battery.

11. The illumination device of claim 10, wherein said at least one battery comprises a plurality of button batteries.

12. An illumination device, comprising:

a translucent housing;

a plurality of light sources disposed in said housing for radiating light; and at least one replaceable power source disposed in said housing for powering said light sources;

wherein said light sources are arranged in said housing such that light radiates from said housing omnidirectionally;

wherein said first portion is rotatable with respect to said second portion such that, when said first portion is rotated from a locked position to an unlocked position, said first portion is separable from said second portion;

wherein said first portion includes a first coupling surface having a gap therein;

wherein said second portion includes a second coupling surface for engaging the first coupling surface; and wherein said second portion includes a protuberance protruding from the second surface for holding said second portion adjacent said first portion, the protuberance corresponding to the shape of the gap such that, when said first portion is rotated to the unlocked position, the protuberance is slideable through the gap to separate said first portion from said second portion.

13. The illumination device of claim 12, wherein said plurality of light sources comprises a plurality of light emitting diodes.

14. The illumination device of claim 13, further comprising at least one resistor, wherein said at least one resistor and said plurality of diodes are connected in series.

15. The illumination device of claim 13, further comprising a rheostat, wherein said rheostat and said plurality of diodes are connected in series.

16. The illumination device of claim 13, wherein said diodes comprise water clear diodes.

17. The illumination device of claim 13, wherein said light emitting diodes have a viewing angle of at least about ninety degrees.

18. An illumination device, comprising:

a housing having an outer surface, said housing comprising;

a first housing portion having a first translucent surface comprising part of the outer surface of said housing; and a second housing portion coupled to said first housing portion along a plane having an x-axis and a y-axis, said second housing portion having a second translucent surface comprising part of the outer surface of said housing;

at least one light source disposed in said first housing portion for radiating light through the first translucent surface, wherein said at least one light source is positioned such that light radiates away from the plane in approximately one hundred and eighty degrees along both the x-axis and the y-axis of the plane;

at least one additional light source disposed in said second housing portion for radiating light through the second translucent surface, wherein said at least one additional light source is positioned such that light radiates away from the plane in approximately one hundred and eighty degrees along both the x-axis and the y-axis of the plane; and at least one replaceable power source disposed in said housing for powering said light sources.

19. The illumination device of claim 18, wherein:

said at least one light source disposed in said first housing portion comprises a plurality of light sources arranged in a substantially spherical array, wherein said array is substantially perpendicular to the plane along which said first housing portion is coupled to said second housing portion; and said at least one light source disposed in said second housing portion comprises a plurality of light sources arranged in a substantially spherical array, wherein said array is substantially perpendicular to the plane along which said first housing portion is coupled to said second housing portion.

20. The illumination device of claim 19, wherein said plurality of light sources comprises a plurality of light emitting diodes.

21. The illumination device of claim 19, further comprising at least one resistor, wherein said at least one resistor and said plurality of light emitting diodes are connected in series.

22. The illumination device of claim 19, further comprising a rheostat, wherein said rheostat and said plurality of diodes are connected in series.

23. The illumination device of claim 20, wherein said diodes comprise water clear diodes.

24. The illumination device of claim 20, wherein said light emitting diodes have a viewing angle of at least about ninety degrees.

25. The illumination device of claim 20, wherein said light emitting diodes are at least about 3000 MCD.

26. The illumination device of claim 18, wherein said first portion comprises a first hemisphere and said second portion comprises a second hemisphere.

27. The illumination device of claim 18, wherein said first housing portion is rotatable with respect to said second housing portion such that, when said first housing portion is rotated from a locked position to an unlocked position, said first housing portion is separable from said second portion.

28. The illumination device of claim 27, wherein;

said first housing portion includes a first coupling surface having a gap therein;

said second housing portion includes a second coupling surface for engaging the first coupling surface; and said second housing portion includes a protuberance protruding from the second surface for holding said second housing portion adjacent said first housing portion, the protuberance corresponding to the shape of the gap such that, when said first housing portion is rotated to the unlocked position, the protuberance is slideable through the gap to separate said first housing portion from said second housing portion.

29. The illumination device of claim 18, wherein;

said at least one power source is electrically connected to said plurality of light sources; and said first housing portion is rotatable with respect to said second housing portion such that, when said first housing portion is rotated from an engaged position to a disengaged position, the electrical connection between said at least one power source and said plurality of light sources is severed.

30. The illumination device of claim 18, wherein said power source comprises at least one battery.

31. The illumination device of claim 30, wherein said at least one battery comprises a plurality of button batteries.

32. An illumination device, comprising:

a housing having a translucent surface;

at least one light emitting diode disposed in said housing for radiating light through the translucent surface, wherein said at least one diode is at least about 3000 MCD; and at least one replaceable battery disposed in said housing for powering said at least one diode;

wherein said housing comprises first and second housing portions, wherein said first portion is removably coupled to said second portion for allowing replacement of said at least one battery;

wherein said at least one battery is electrically connected to said at least one light emitting diode; and wherein said first housing portion is rotatable with respect to said second housing portion such that, when said first housing portion is rotated from an engaged position to a disengaged position, the electrical connection between said at least one battery and said at least one diode is severed.

33. The illumination device of claim 32, further comprising at least one resistor, wherein said at least one resistor and said plurality of light emitting diodes are connected in series.

34. The illumination device of claim 32, further comprising a rheostat, wherein said rheostat and said plurality of diodes are connected in series.

35. The illumination device of claim 32, wherein said diodes comprise water clear diodes.

36. The illumination device of claim 32, wherein said at least one diode has a viewing angle of at least about ninety degrees.

37. The illumination device of claim 36, wherein said at least one diode comprises a plurality of diodes arranged in a substantially spherical array.

38. An illumination device, comprising:

a housing having a translucent surface;

at least one light emitting diode disposed in said housing for radiating light through the translucent surface, wherein said at least one diode is at least about 3000 MCD; and at least one replaceable battery disposed in said housing for powering said at least one diode;

wherein said housing comprises first and second housing portions, wherein said first portion is removably coupled to said second portion for allowing replacement of said at least one battery;

wherein said first housing portion is rotatable with respect to said second housing portion such that, when said first housing portion is rotated from a locked position to an unlocked position, said first housing portion is separable from said second portion;

wherein said first housing portion includes a first coupling surface having a gap therein;

wherein said second housing portion includes a second coupling surface for engaging the first coupling surface; and wherein said second housing portion includes a protuberance protruding from the second surface for holding said second housing portion adjacent said first housing portion, the protuberance corresponding to the shape of the gap such that, when said first housing portion is rotated to the unlocked position, the protuberance is slideable through the gap to separate said first housing portion from said second housing portion.

* * * * *